8/8/78 XR 4,106,000

United States Patent [19]

Maillot

[11] 4,106,000

[45] Aug. 8, 1978

[54] ANTI-THEFT DEVICE WITH DISABLING MEANS

[75] Inventor: Jean Maillot, Paris, France

[73] Assignee: Paulette Guterman, Gif sur Yvette, France

[21] Appl. No.: 675,514

[22] Filed: Apr. 9, 1976

[30] Foreign Application Priority Data

Dec. 23, 1975 [FR] France ..... 75 39551

[51] Int. Cl.[2] ..... G08B 13/00

[52] U.S. Cl. ..... 340/530; 340/566; 340/545

[58] Field of Search ..... 340/261, 64, 65, 63, 340/274 R, 274 C, 213 R

[56] References Cited

U.S. PATENT DOCUMENTS

| | | | |
|---|---|---|---|
| 3,717,864 | 2/1973 | Cook et al. | 340/261 |
| 3,771,152 | 11/1973 | Dettling et al. | 340/276 |
| 3,781,854 | 12/1973 | Kaufman et al. | 340/64 |
| 3,930,226 | 12/1975 | Plumberg | 340/64 |

*Primary Examiner*—Glen R. Swann, III

*Attorney, Agent, or Firm*—Wolf, Greenfield & Sacks

[57] ABSTRACT

A sensing means is connected to the input of an electronic circuit for triggering a signalling means. The electronic circuit includes a continuous differential amplifier whose two inputs (−) and (+) are connected to the terminals of the sensing means. The input terminals are also connected by means of at least two switches to voltage sources in such a way that, by closing one of the switches, the polarity of the input terminal in question is reversed, to disable the detection device, and, by closing the other switch means, there is an increase, with the same sign, in the polarity of the input in question, for triggering the signalling means.

13 Claims, 2 Drawing Figures

Figure : 1
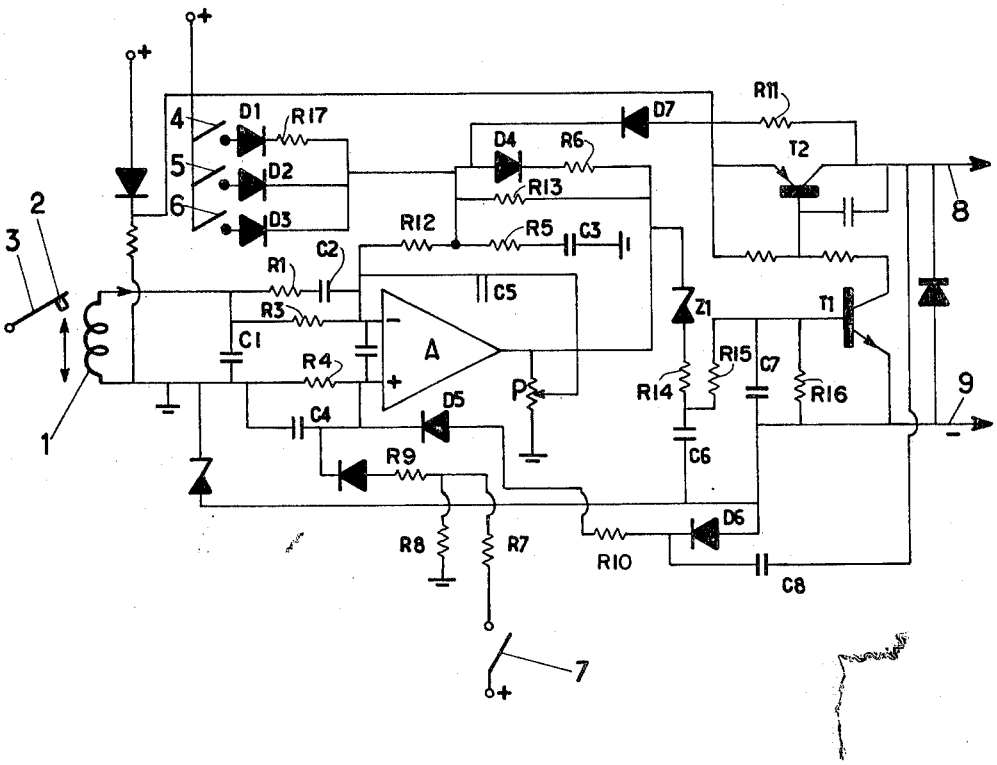
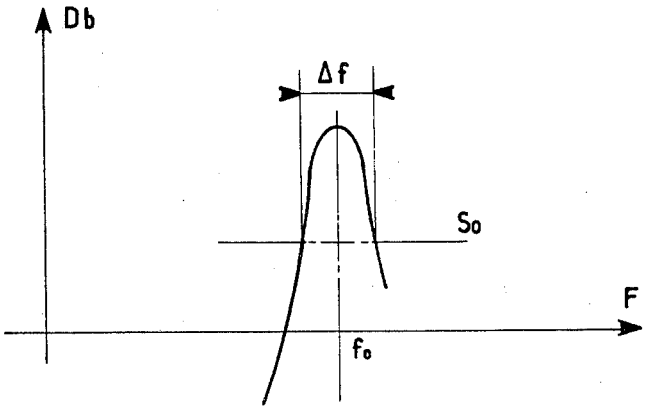
Figure : 2

ANTI-THEFT DEVICE WITH DISABLING MEANS

BACKGROUND AND SUMMARY OF THE INVENTION

The invention concerns a detector device, in particular an anti-theft device.

The device of the invention comprises a sensing means connected to the input of an electronic circuit for triggering a signalling means, and is characterized in that the electronic circuit comprises a continuous differential amplifier whose two inputs (−) and (+) are connected to the terminals of the sensing means, said input terminals also being connected by way of at least two switching means to voltage sources such that, by closing one of the switching means, the polarity of the input terminal in question is inverted, to disable the detection device, and that, by closing the other switching means, with the same sign there is an increase in the polarity of the input terminal in question, for triggering the signalling means.

In accordance with another feature of the invention, each input terminal is connected by way of at least one switching means to the polarity having the same sign of a voltage source, such that closing one of the switching means connected to one of the inputs causes disabling of the device, and that the other switching means connected to the other input causes triggering of the signalling means.

In accordance with another feature of the invention, the switching means for disabling the device comprises, in its connection to the corresponding input of the amplifier, a resistance-capacitance circuit with a substantial time constant, for ensuring slow charging of the capacitance, to cause closure of the switching means to be maintained for a given period.

In accordance with another characteristic of the invention, the capacitance of the disabling circuit, charging of which occurs with a high time constant, is arranged in a discharge circuit comprising a diode and having a longer discharge time constant than the charging time constant, to ensure time delay of the disabling action.

DESCRIPTION OF DRAWINGS

The invention is illustrated by way of non-limitative example in the accompanying drawings, in which:

FIG. 1 shows an electrical diagram of the device,

FIG. 2 shows the response diagram of the whole of the device.

DETAILED DESCRIPTION

The device according to the invention accordingly comprises a device which provides for detection of any signal, such as an audio or photo signal, in order to produce triggering of an alarm.

In the following description, the construction of the device according to the invention will be described with more particular reference to an anti-theft device which can be disposed for example on a motor vehicle.

For triggering purposes, the device is therefore connected to a sensing means, for example to a vibration sensing means, but it also has disabling circuits permitting the owner of the vehicle to cancel the effects of the device, as well as trapping means which, independently of the sensing means, provide triggering of the alarm when a person tries to disable the detector device in order to enter the vehicle by breaking in.

The device of the invention also has the advantage of comprising particular operating conditions for the disabling means, the trapping means and for the sensing means. Thus, as regards the disabling means, the device makes it necessary, for there to be effective disabling, that the operator has the wish to effect a disabling action, whereas, on the contrary, the construction of the trapping control causes triggering of the device, even in the case of temporary actuation. Likewise, the vibration sensing means is associated with filtering means which, in the case of a motor vehicle, select the frequencies of the vibrations produced when there is an attempt to break into the vehicle, eliminating the upper or lower frequencies which can be produced by other causes.

Besides the particular operating conditions of the sensing means, the disabling means and the trapping means, the electronic circuit associated with such means, in itself, makes it possible to provide for adjustment of the sensitivity of the device and to prevent triggering thereof in the event of phenomena which undergo slow variations, such as temperature variations, or slow vibrations caused for example by the wind acting on the side of the vehicle.

Equally, this device has the advantage of being automatically disabled for a brief moment after the end of an alarm, in order in particular to prevent the device being automatically being triggered off again by the break sparks produced when the alarm is terminated. In addition, among the frequencies which are capable of causing triggering of the alarm, the device prevents triggering of the alarm when a small number of signals is produced in said range of frequencies, in order to distinguish an attempt at breaking in, from an accidental impact which occurs in the frequency range in question.

Thus, accompanying FIG. 1 shows the electrical diagram of the device, the device being connected in the embodiment illustrated to a vibrating sensing means which comprises a coil 1 provided with a plunger core 2 which is fixed to the end of a flexible blade 3 in such a way that vibration of the blade causes the production of a signal which is detected by the device.

Also, the circuit is connected to disabling switching means 4, 5 and 6 which are intended temporarily to prevent functioning of the device, and to switching means such as 7 which, in contrast, is intended to immediately cause triggering of the alarm. The alarm can be a visual means, a sound means or a light means, and will be connected between the output terminals 8 and 9.

The device according to the invention comprises an operational amplifier whose terminals (−) and (+) are connected to the terminals of the winding 1 of the sensing means by a band pass filter comprising components C1 and R3 for the low pass part and C2 and R1 for the high pass part. This filter makes it possible to select, from the vibrations of the flexible blade 3, those vibrations whose frequency corresponds to the frequencies produced when an attempt is made to break into a vehicle. Thus, the filtering circuit, associated with the structural features of the whole of the circuit, will ensure triggering of the alarm in a narrow frequency band $\Delta f$, while automatically excluding higher or lower frequencies which do not correspond to a break-in attempt.

Of the switching means for producing the disabling action, one of them, for example the switching means 5, can be associated with the ignition key in order to prevent the device being set in operation when the vehicle engine is started. Also, one of the switching means, for example the switching means 6, may comprise a circuit breaker switch which is arranged within the vehicle in a particular position which is known only to the owner of the vehicle, so that he can prevent the alarm device being set in operation, even if he does not start the engine.

As regards the other switching means 4 and 7, they can comprise magnetically actuated switching tubes or ampoules in such a way that at least one switching tube for the disabling means 4 is disposed in the vicinity of at least one switching tube for the trapping means 7, said tubes which are adjacent but which are of different functions being arranged on the vehicle so that they can be actuated from the exterior by a magnet. For example, these adjacent tubes can be disposed within the vehicle against the windscreen.

It will be appreciated in consequence that these tubes of different functions will make it possible to prevent disabling of the anti-theft device by any person who is not instructed therein, since such a person will not be able to ascertain which of the switching means is intended to produce the disabling action.

This safety measure can be further increased by multiplying the number of switching tubes 7 for producing the trapping action, in the vicinity of a switching tube 4 for providing the disabling action, and only the owner of the vehicle who knows the precise position of the switching tube 4 will be able to disable the detection device before entering the vehicle.

The assembly formed by the disabling and switching tubes can be in the form of a plate or the like, provided with markers of different colours or figures in vertical alignment with various tubes, so that only the owner of the vehicle who knows the code can act in order to produce disabling of the device, without triggering the alarm, by acting on a switching means 7.

The switching means 4, 5 and 6 are disposed in parallel circuits which respectively comprise diodes D1, D2 and D3. These circuits are connected on the one hand to the positive pole of a voltage source and on the other hand to the input (−) of the operational amplifier A. It will be seen therefore that closing one of the switching means 4, 5 and 6 blocks the operation amplifier A by reversing the polarity of its input (−).

Also arranged in this circuit connection is a capacitor C3 which is connected to the internal ground of the device so as to form, with the resistors R5 and R17, a RC circuit having a high time constant, so that a fleeting and therefore involuntary action by means of a magnet on the switching tube 4 would not have the time to charge the capacitor C3 and thus to reverse the polarity (−) of the operation amplifier.

The circuit for discharging the capacitor C3 comprises a diode D4 and a resistor R6 which, with the capacitor C3, form a circuit whose time constant is determined to produce a time delay in the disabling and to give the owner of the vehicle time to enter his vehicle and start it by the ignition key, before the capacitor C3 has discharged and before the device can be triggered by a vibration as detected by the winding 1. In fact, as soon as the owner has started his vehicle, he has automatically closed the switch 5, which thus holds the detection device in a disabled condition.

The switching tubes 7 of the trapping circuit, which ensure, when actuated, that the alarm is set in operation, are arranged in the embodiment illustrated between the positive pole of the voltage source and the positive input of the operational amplifier A. Accordingly, when the switching tube 7 is closed, there is an increase, with the same sign, in the polarity of the positive input of the amplifier, to cause actuation of the alarm by the transistors T1 and T2.

The trapping circuit comprises an RC circuit formed by a capacitor C4 and resistors R7, R8, and R9 so that charging of the capacitor C4, when the switching means 7 is closed, can cause triggering of the alarm, even if closure of the switch 7 is momentary.

It will therefore be noted that in this circuit a momentary action on the disabling means 4 does not produce disabling, whereas, in contrast, momentary action on the trapping means 7 immediately produces triggering of the alarm.

Moreover, a resistor R6 which is part of the circuit for charging capacitor C3 is arranged in the parallel circuit comprising the switching tube 4, so that the blocking voltage applied to the input (−) of the amplifier, irrespective of what it is, is lower than the positive voltage applied to the positive input of the amplifier when the trapping switch means 7 is actuated. This arrangement accordingly provides for priority of the trapping action over the disabling action.

The output of the amplifier A is provided with a potentiometer P whose slider is connected to the negative input of the amplifier and therefore in opposition to the signal coming from the sensing means, in order to reduce the amplifier gain. Also, this circuit connection comprises a capacitor C5 which with the potentiometer P forms a low pass filter contributing to elimination of the elevated frequencies which can be induced by electrical parasites or brief jolts. In addition, by virtue of the resistors R12, R13 and R3, the gain of the amplifier is adjusted to be close to unity, for all the low frequencies lower than the operating frequencies of the device, for example so as to cancel the frequencies of vibrations produced by wind acting on the side of the vehicle. Also, this arrangement makes it possible to compensate for temperature drifts of the device, which are also to be considered as parasitic phenomena at very low frequency.

The output of the operational amplifier A is connected to the base of the transistor T1 by a circuit comprising the Zener diode Z1 and integrating or low pass filter circuits R14, C6 and R15, C7 and R16. In this circuit, nothing is produced as long as the output voltage of the amplifier A is lower than the unblocking voltage of the diode Z1. On the other hand, the output signals of the amplifier A, higher than the unblocking voltage for Z1, are integrated by the network R14, C6, R15, C7 and R16, to unblock the transistor T1 and produce triggering of the alarm only after a certain plurality of alarm signals. This arrangement therefore provides a threshold triggering circuit so that, to produce triggering of the alarm, it is necessary to produce several signals of sufficient levels so at the working frequency fo of the device so as categorically to distinguish an attempt to break into the vehicle, which requires the production of several signals of given frequencies and levels, from a phenomenon which is to be considered as normal and which is caused for example by any impact against the vehicle.

This circuit is discharged by means of the resistor R16 and the capacitor C7.

Besides the capacitor C4 which provides for maintenance of the actuation signal at the positive input of the amplifier A, there is provided a capacitor C8 associated with the diode D5 and with the resistor R10, this series circuit being connected between the output 8 of the device and the positive input of the amplifier.

In this circuit, when a signal triggers the alarm, for example by means of a relay, the capacitor C8 begins to charge up, and the charge on this capacitor is re-injected at the positive input of the amplifier to provide a self-holding action for the relay and therefore the alarm. However, when the capacitor C8 is charged, there is no longer any current at the positive input of the amplifier and if the signal originating from the coil 1 of the sensing means is no longer present, the relay drops out again. Therefore, this circuit provides a memory effect, for a period defined by C8 and R10, in respect of the triggering signal in order to hold the alarm device in the triggered condition.

In this circuit, the diode D6 forms the circuit for discharging the capacitor C8.

The output 8 of the device is also connected by a series circuit comprising the resistor R11 and the diode D7, and the switching means for the disabling action, that is to say, the input (−) of the amplifier, in order to provide for blocking of the device for a short moment after the end of the alarm. This construction therefore prevents an alarm from being immediately triggered from the break sparks produced at the end of the preceding alarm.

It will be apparent that the invention is not limited to the embodiment described and illustrated, on the basis of which other embodiments and other constructions can be envisaged without thereby departing from the scope of the invention.

I claim:

1. A detector device, in particular an anti-theft device, comprising a sensing means connected to the input of an electronic circuit for triggering a signalling means at the output of the device, the device being characterized in that the electronic circuit comprises a difference amplifier whose two input terminals (−) and (+) are connected to the sensing means, said input terminals also being connected by means of at least two switching means to voltage sources in such a way that, by closing one of the switching means, the polarity of the input terminal in question is reversed, to disable the detector device, and, by closing the other switching means, there is an increase, with the same sign, in the polarity of the input terminal in question, for triggering the signalling means.

2. A device according to claim 1 characterized in that each input terminal is connected by at least one switching means to the same polarity of one of the voltage sources, in such a way that closing one of the switching means connected to one of the inputs causes disabling of the device, and that closing the other switching means connected to the other input causes triggering of the signalling means.

3. A device according to claim 2, characterized in that the switching means for disabling the device comprises, in its connection to the corresponding input of the amplifier, a resistance-capacitance circuit with a substantial time constant, for ensuring slow charging of the capacitance, to require closure of the switching means to be maintained for a given time.

4. A device according to claim 3, characterized in that the capacitance which is charged with a substantial time constant is arranged in a discharge circuit comprising a diode and having a longer discharge time constant than the charging time constant, to provide a holding time delay for the disabling action.

5. A device according to claim 1, characterized in that the switching means for triggering the signalling means comprises, in its connection to the corresponding input of the amplifier, a resistance-capacitance circuit, in which charging of the capacitance ensures that the signalling means is held for a time delay in the triggered condition after the end of the alarm.

6. A device according to claim 1, characterized in that a capacitor is connected on the one hand to a connection of the electronic circuit to the signalling means, and on the other hand to the input of the amplifier connected to the switching means for triggering the signalling means, for producing self-holding of the triggering of the signalling means.

7. A device according to claim 1, characterized in that it comprises a plurality of switching means connected in parallel for disabling the device, at least one of the switching means being arranged in series with a resistor to ensure that triggering actuation has priority over the disabling actuation by said switching means.

8. A device according to claim 4, characterized in that it comprises means for adjusting sensitivity, formed by a potentiometer arranged at the output of the amplifier, the slider of which potentiometer is connected by a capacitor to the input of the amplifier in opposition to the input signal originating from the sensing means, in order to reduce the amplifier gain.

9. A device according to claim 4, characterized in that at least one disabling switching means and at least one triggering switching means are arranged adjacent to each other.

10. A device according to claim 4, characterized in that the switching means comprise magnetically actuated switching tubes or ampoules.

11. A device according to claim 4, characterized in that it comprises a band pass filter between the sensing means and the input terminals of the amplifier.

12. A device according to claim 1, characterized in that a series circuit comprising a diode and a resistor is arranged between the output of the device and the disabling switching means, to provide for blocking of the device for a short moment after the end of an alarm, so that it is not automatically re-triggered when the signalling means is stopped.

13. A device according to claim 8, characterized in that the output of the amplifier is connected to an output circuit including a diode, a resistance-capacitance integrating circuit, and a transistor for the threshold triggering of the transistor and to prevent triggering of the signalling means by a number of small of triggering signals.

* * * * *